US005944243A

United States Patent [19]

Weinstein

[11] Patent Number: 5,944,243

[45] Date of Patent: Aug. 31, 1999

[54] ILLUMINATED PILL SPLITTER WITH MAGNIFYING GLASS

[76] Inventor: Harvey Weinstein, 29 G Forest Dr., Garnerville, N.Y. 10923

[21] Appl. No.: 09/095,978

[22] Filed: Jun. 11, 1998

[51] Int. Cl.[6] ..... B26F 3/00

[52] U.S. Cl. ..... 225/93; 225/103; 30/124

[58] Field of Search ..... 225/103, 93; 30/124; 206/528

[56] References Cited

U.S. PATENT DOCUMENTS

| | | | |
|---|---|---|---|
| 2,655,259 | 10/1953 | Davoren | 225/103 |
| 3,517,871 | 6/1970 | Gaffney et al. | 225/103 |
| 4,173,826 | 11/1979 | Leopoldi et al. | 225/103 |
| 4,179,806 | 12/1979 | Lieptz | 225/103 |
| 4,473,192 | 9/1984 | Urban | 225/93 |
| 5,118,021 | 6/1992 | Fiocchi | 225/103 |

*Primary Examiner*—M. Rachuba

[57] ABSTRACT

A pill splitting device is provided including a housing. Also included is a razor blade movable with respect to the housing for splitting a pill therein.

16 Claims, 3 Drawing Sheets

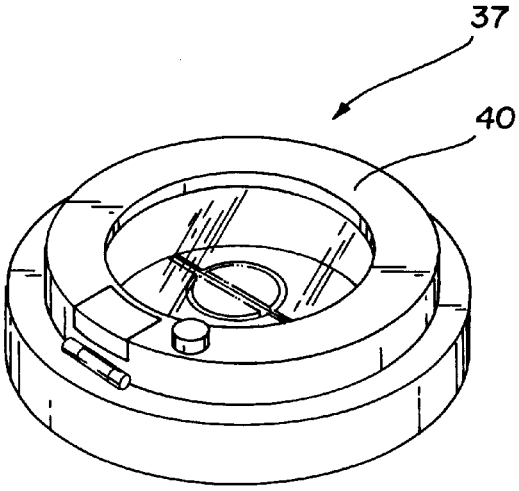
FIG.3
FIG.4
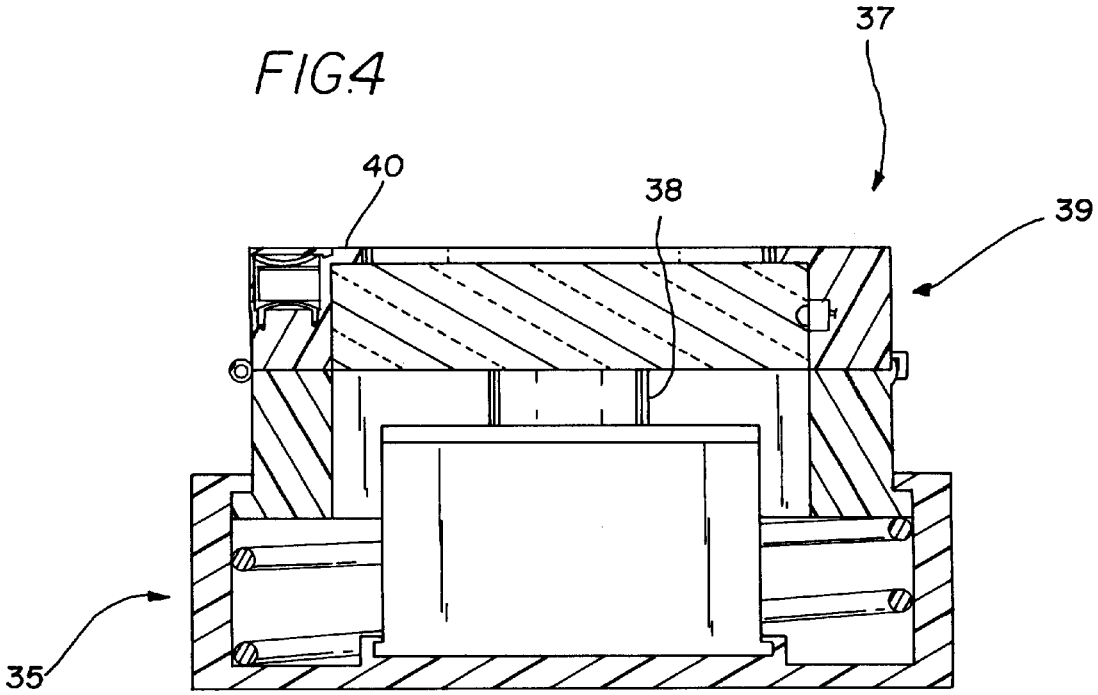

ILLUMINATED PILL SPLITTER WITH MAGNIFYING GLASS

BACKGROUND OF THE INVENTION

1. Field of the Invention

The present invention relates to pill splitting devices and more particularly pertains to a new illuminated pill splitter with magnifying glass for accurately splitting a pill in a convenient, safe manner.

2. Description of the Prior Art

The use of pill splitting devices is known in the prior art. More specifically, pill splitting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art pill splitting devices and the like include U.S. Pat. No. 5,038,475; U.S. Pat. No. 4,763,986; U.S. Pat. No. 4,179,806; U.S. Pat. No. 1,201,067; U.S. Pat. No. 3,175,746; and Foreign Patent No. EP 0 382 452 A1 and EP 0 085 325 A1.

In these respects, the illuminated pill splitter with magnifying glass according to the present invention substantially departs from the conventional concepts and designs of the prior art, and in so doing provides an apparatus primarily developed for the purpose of accurately splitting a pill in a convenient, safe manner.

SUMMARY OF THE INVENTION

In view of the foregoing disadvantages inherent in the known types of pill splitting devices now present in the prior art, the present invention provides a new illuminated pill splitter with magnifying glass construction wherein the same can be utilized for accurately splitting a pill in a convenient, safe manner.

The general purpose of the present invention, which will be described subsequently in greater detail, is to provide a new illuminated pill splitter with magnifying glass apparatus and method which has many of the advantages of the pill splitting devices mentioned heretofore and many novel features that result in a new illuminated pill splitter with magnifying glass which is not anticipated, rendered obvious, suggested, or even implied by any of the prior art pill splitting devices, either alone or in any combination thereof.

To attain this, the present invention generally comprises a housing with a rectangular configuration. The housing includes a bottom face, a top face and a peripheral side wall coupled between peripheries of the top and bottom face for defining a hollow interior space. The peripheral side wall is defined by a rear face and a pair of side faces for defining an open front. For reasons that will soon become apparent, an upwardly extending lip is coupled along a front edge of the bottom face. As shown in FIG. 6, the housing further includes a primary divider mounted between the side faces adjacent to the rear face for defining a small rear compartment and a large front compartment. The housing further includes a plurality of secondary dividers coupled between the rear face and the primary divider for defining a plurality of subcompartment. A plurality of lids are adapted for selectively sealing the subcompartments individually. A circular magnifying glass is mounted in the top face of the housing above the front compartment. A disk-shaped recess is formed in an uppers surface of the bottom face of the housing within the front compartment. Next provided is a planar rectangular razor blade with a sharp lower edge and a dull upper edge. In use, the razor blade is slidably situated within a pair of opposed vertical slots formed in the side faces of the housing. It should be noted that a plane in which the blade resides bisects the disk-shaped recess. In the preferred embodiment, a pair of springs are mounted between the lower edge of the razor blade and the bottom face of the housing for urging the razor blade against the top face thereof. Finally, a pair of light assemblies are each mounted on an inner surface of one of the side faces of the housing adjacent to the primary divider for illuminating the interior space of the housing upon the actuation thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new illuminated pill splitter with magnifying glass apparatus and method which has many of the advantages of the pill splitting devices mentioned heretofore and many novel features that result in a new illuminated pill splitter with magnifying glass which is not anticipated, rendered obvious, suggested, or even implied by any of the prior art pill splitting devices, either alone or in any combination thereof.

It is another object of the present invention to provide a new illuminated pill splitter with magnifying glass which may be easily and efficiently manufactured and marketed.

It is a further object of the present invention to provide a new illuminated pill splitter with magnifying glass which is of a durable and reliable construction.

An even further object of the present invention is to provide a new illuminated pill splitter with magnifying glass which is susceptible of a low cost of manufacture with regard to both materials and labor, and which accordingly is then susceptible of low prices of sale to the consuming public, thereby making such illuminated pill splitter with magnifying glass economically available to the buying public.

Still yet another object of the present invention is to provide a new illuminated pill splitter with magnifying glass which provides in the apparatuses and methods of the prior art some of the advantages thereof, while simultaneously overcoming some of the disadvantages normally associated therewith.

Still another object of the present invention is to provide a new illuminated pill splitter with magnifying glass for accurately splitting a pill in a convenient, safe manner.

Even still another object of the present invention is to provide a new illuminated pill splitter with magnifying glass that includes a housing and a razor blade movable with respect to the housing for splitting a pill therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a perspective view of the embodiment of FIG. 1 with the lid closed.

FIG. 4 is a cross-sectional view of the present invention taken along line 4—4 shown in FIG. 1.

DESCRIPTION OF THE PREFERRED EMBODIMENT

Figure 1:
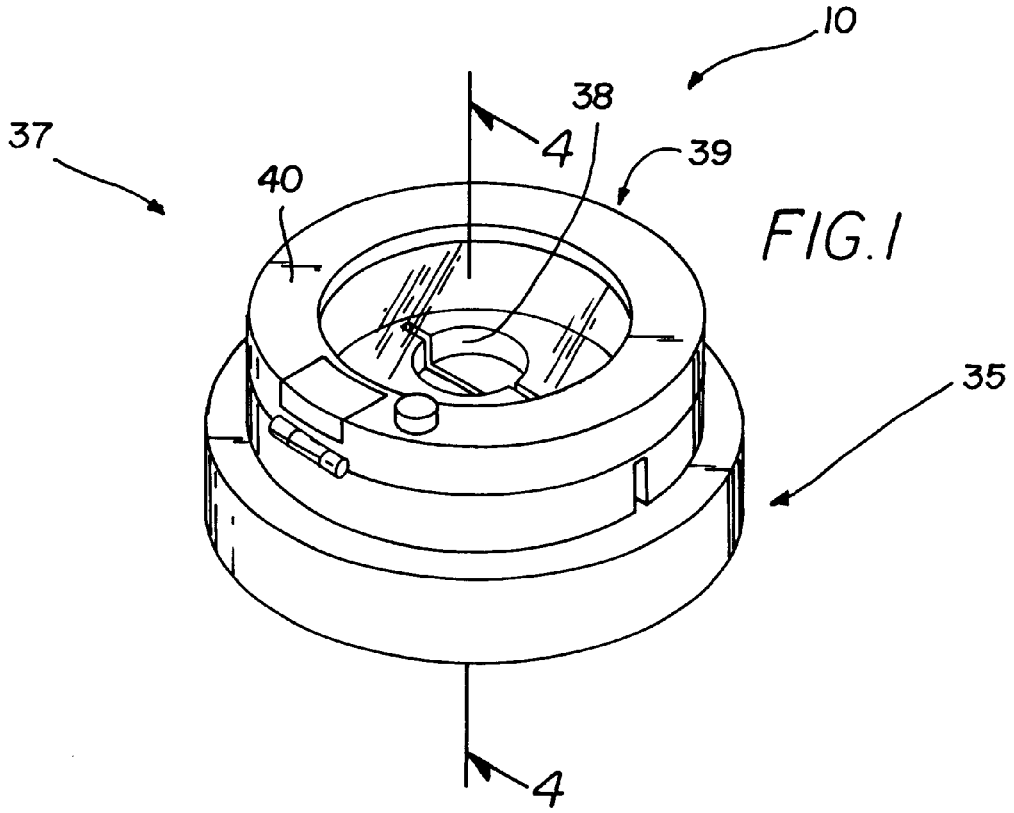
FIG. 1 is a perspective view of one of the embodiments of the present invention.

With reference now to the drawings, and in particular to FIGS. 1 through 6 thereof, a new illuminated pill splitter with magnifying glass embodying the principles and concepts of the present invention and generally designated by the reference numeral 10 will be described.

Figure 5:
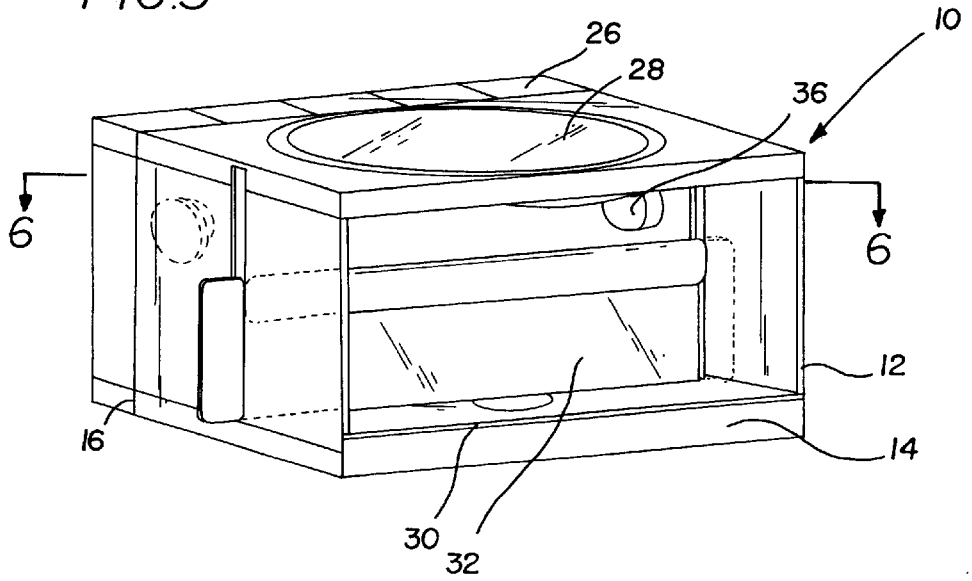
FIG. 5 is a perspective view of another embodiment of the present invention.
Figure 6:
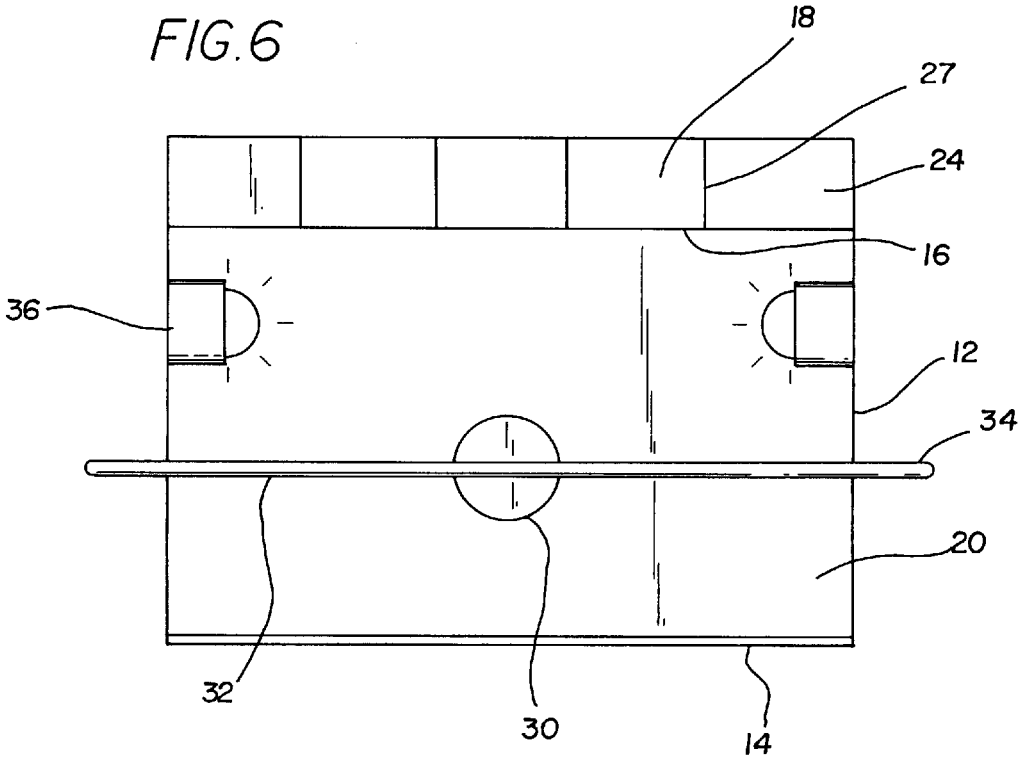
FIG. 6 is a top cross-sectional view of the embodiment of the present invention shown in FIG. 5.

The present invention, designated as numeral 10, includes a pair of embodiments the first of which is shown in FIGS. 1–4 and the second of which is shown in FIGS. 5 & 6. The embodiment of FIGS. 5 & 6, which is preferred, will first be described.

The embodiment of FIGS. 5 & 6 includes a housing 12 with a rectangular configuration. The housing includes a bottom face, a top face and a peripheral side wall coupled between peripheries of the top and bottom face for defining a hollow interior space. The peripheral side wall is defined by a rear face and a pair of side faces for defining an open front. For reasons that will soon become apparent, an upwardly extending lip 14 is coupled along a front edge of the bottom face. As shown in FIG. 6, the housing further includes a primary divider 16 mounted between the side faces adjacent to the rear face for defining a small rear compartment 18 and a large front compartment 20.

The housing further includes a plurality of secondary dividers 22 coupled between the rear face and the primary divider for defining a plurality of subcompartments 24. A plurality of removable lids 26 are adapted for selectively sealing the subcompartments individually. A circular magnifying glass 28 is mounted in the top face of the housing above the front compartment. A disk-shaped recess 30 is formed in an uppers surface of the bottom face of the housing within the front compartment. The disk-shaped recess is sized to contain a pill therein. It should be noted that the recess preferably has a depth less than ¼ that of the pill.

Next provided is a planar rectangular razor blade 32 with a sharp lower edge and a dull upper edge. In use, the razor blade is slidably situated within a pair of opposed vertical slots 34 formed in the side faces of the housing. It should be noted that a plane in which the blade resides bisects the disk-shaped recess. In the preferred embodiment, a pair of unillustrated springs are mounted between the lower edge of the razor blade and the bottom face of the housing for urging the razor blade upwardly.

Finally, a pair of light assemblies 36 are each mounted on an inner surface of one of the side faces of the housing adjacent to the primary divider for illuminating the front compartment of the housing upon the actuation thereof. A switch(not shown) may be mounted on the housing for selectively actuating the light assemblies.

Figure 2:
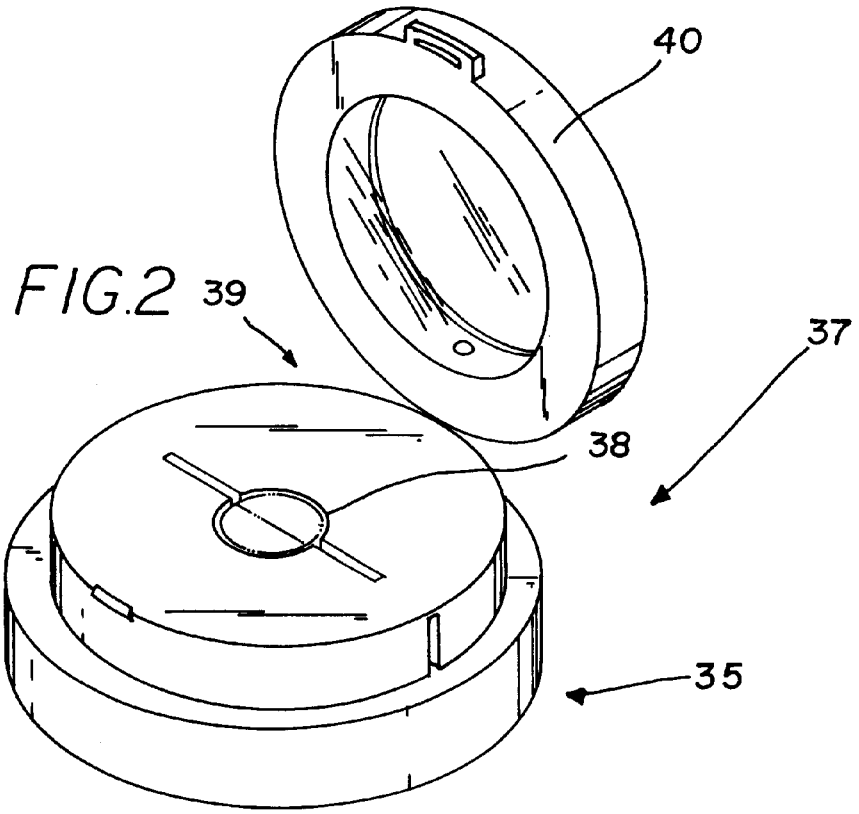
FIG. 2 is a perspective view of the embodiment of FIG. 1 with the lid open.

With reference now to FIGS. 1–4, a second embodiment 37 of the present invention is shown. In such embodiment, the razor blade is fixedly mounted to a lower portion 35 of the housing. An upper portion 39 of the housing is equipped with a recess 38 and is slidable with respect to the lower portion for allowing the razor blade to penetrate a pill within the recess. As shown in FIGS. 2 & 4, the upper portion of the housing preferably has a hinged lid 40 with a magnifying glass mounted therein. In the present embodiment, the light assemblies are mounted on the lid. Further, the lid is openable to allow the placement of the pill within the recess.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pill splitting device comprising, in combination:

a housing with a rectangular configuration including a bottom face, a top face and a peripheral side wall coupled between peripheries of the top and bottom face for defining a hollow interior space, the peripheral side wall defined by a rear face and a pair of side faces for defining an open front with an upwardly extending lip coupled along a front edge of the bottom face, the housing further including a primary divider mounted between the side faces adjacent to the rear face for defining a small rear compartment and a large front compartment, the housing further including a plurality of secondary dividers coupled between the rear face and the primary divider for defining a plurality of subcompartments, a plurality of lids for selectively sealing the subcompartments individually, a circular magnifying glass formed in the top face of the housing above the front compartment, and a disk-shaped recess formed in an uppers surface of the bottom face of the housing within the front compartment;

a planar rectangular razor blade with a sharp lower edge and a dull upper edge, the razor blade being slidably situated within a pair of opposed vertical slots formed in the side faces of the housing, wherein a plane in which the blade resides bisects the disk-shaped recess; and a pair of light assemblies each mounted on an inner surface of one of the side faces of the housing adjacent to the primary divider for illuminating the interior space of the housing upon the actuation thereof.

2. A pill splitting device comprising:

a housing; and a razor blade movable with respect to the housing for splitting a pill therein;

wherein at least one light is situated within the housing for viewing the pill.

3. A pill splitting device as set forth in claim 2 wherein a magnifying glass is mounted on the housing for viewing the pill therethrough.

4. A pill splitting device as set forth in claim 3 wherein the magnifying glass is situated over the razor blade.

5. A pill splitting device as set forth in claim 2 wherein the housing has a recess formed therein for containing the pill prior to splitting.

6. A pill splitting device as set forth in claim 2 wherein the housing has at least one compartment with a lid for housing a plurality of pills prior to splitting.

7. A pill splitting device as set forth in claim 2 wherein the razor blade is slidable within a pair of slots formed in the housing.

8. A pill splitting device comprising:

a housing; and a razor blade movable with respect to the housing for splitting a pill therein;

wherein a magnifying glass is mounted on the housing for viewing the pill therethrough.

9. A pill splitting device as set forth in claim 8 wherein the magnifying glass is situated over the razor blade.

10. A pill splitting device as set forth in claim 8 wherein the housing has a recess formed therein for containing the pill prior to splitting.

11. A pill splitting device as set forth in claim 8 wherein the housing has at least one compartment with a lid for housing a plurality of pills prior to splitting.

12. A pill splitting device as set forth in claim 8 wherein the razor blade is slidable within a pair of slots formed in the housing.

13. A pill splitting device comprising:

a housing; and a razor blade movable with respect to the housing for splitting a pill therein;

wherein the razor blade is slidable within a pair of slots formed in the housing.

14. A pill splitting device as set forth in claim 13 wherein a magnifying glass is situated over the razor blade.

15. A pill splitting device as set forth in claim 13 wherein the housing has a recess formed therein for containing the pill prior to splitting.

16. A pill splitting device as set forth in claim 13 wherein the housing has at least one compartment with a lid for housing a plurality of pills prior to splitting.

* * * * *